US010254706B2

(12) United States Patent
Katsumata

(10) Patent No.: US 10,254,706 B2
(45) Date of Patent: Apr. 9, 2019

(54) IMAGE FORMING APPARATUS HAVING A CONTACT/SEPARATION MECHANISM FOR MOVING A DEVELOPING DEVICE

(71) Applicant: CANON KABUSHIKI KAISHA, Tokyo (JP)

(72) Inventor: Go Katsumata, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/844,978

(22) Filed: Dec. 18, 2017

(65) Prior Publication Data

US 2018/0120759 A1 May 3, 2018

Related U.S. Application Data

(62) Division of application No. 15/001,661, filed on Jan. 20, 2016, now Pat. No. 9,885,998.

(30) Foreign Application Priority Data

Jan. 21, 2015 (JP) ..... 2015-009831

(51) Int. Cl.
*G03G 21/00* (2006.01)
*G03G 21/16* (2006.01)
*G03G 21/18* (2006.01)

(52) U.S. Cl.
CPC ..... *G03G 21/1633* (2013.01); *G03G 21/1821* (2013.01); *G03G 21/1842* (2013.01); *G03G 2221/169* (2013.01)

(58) Field of Classification Search
CPC ..... G03G 21/1633; G03G 21/1676; G03G 21/1821; G03G 21/1842; G03G 2221/163; G03G 2221/169
(Continued)

(56) References Cited

U.S. PATENT DOCUMENTS 6,104,897 A 8/2000 Ishizawa
7,792,460 B2 9/2010 Yamaguchi et al.
(Continued)

FOREIGN PATENT DOCUMENTS

JP 2005-004069 A 1/2005
JP 2006-308771 A 11/2006
(Continued)

OTHER PUBLICATIONS

Japanese Office Action dated Sep. 4, 2018, in related Japanese Patent Application No. 2015-009831.

*Primary Examiner* — Robert B Beatty
(74) *Attorney, Agent, or Firm* — Venable LLP

(57) ABSTRACT

An image forming apparatus includes an elastic member applying an urging force to a drum cartridge toward an upstream side of a mounting direction of the drum cartridge against a mounting operation thereof, and an engaging portion engaging with the drum cartridge receiving the urging force to restrict movement of the drum cartridge from a mounted position toward the upstream side in the mounting direction. The drum cartridge includes a release member for releasing engagement between the drum cartridge and an engaging portion, wherein the drum cartridge is moved to a predetermined position in an upstream side of the mounting position with respect to the mounting direction by receiving the urging force upon release of the engagement between the drum cartridge and the engaging portion, and the drum cartridge positioned at a predetermined position contacts a rotatable member subjected to a closing operation to restrict rotation of the rotating member.

11 Claims, 12 Drawing Sheets

(58) Field of Classification Search
USPC ..... 399/110, 111, 113
See application file for complete search history.

(56) References Cited

U.S. PATENT DOCUMENTS

| | | | |
|---|---|---|---|
| 7,840,156 | B2 | 11/2010 | Inaba |
| 7,974,553 | B2 | 7/2011 | Matsuo et al. |
| 9,235,161 | B2 | 1/2016 | Kawasumi |
| 2010/0098452 | A1 | 4/2010 | Inaba |
| 2011/0299885 | A1 | 12/2011 | Taba |
| 2011/0305479 | A1 | 12/2011 | Nishiuwatoko et al. |
| 2013/0170853 | A1 | 7/2013 | Lee et al. |

FOREIGN PATENT DOCUMENTS

| | | | |
|---|---|---|---|
| JP | 2007-079488 | A | 3/2007 |
| JP | 2009-288310 | A | 12/2009 |
| JP | 2010-078873 | A | 4/2010 |
| JP | 2010-097076 | A | 4/2010 |
| JP | 2010-271408 | A | 12/2010 |
| JP | 2012-150522 | A | 8/2012 |
| JP | 2013-003378 | A | 1/2013 |
| JP | 2014-102425 | A | 6/2014 |
| WO | 98/30938 | A1 | 7/1998 |

(a)

(b)

(a)

(b)

IMAGE FORMING APPARATUS HAVING A CONTACT/SEPARATION MECHANISM FOR MOVING A DEVELOPING DEVICE

This application is a divisional of application Ser. No. 15/001,661, filed Jan. 20, 2016.

FIELD OF THE INVENTION AND RELATED ART

The present invention relates to an image forming apparatus such as a printing machine, a copying machine, a facsimile machine, and a multifunction machine which uses an electrophotographic technology. In particular, it relates to an image forming apparatus equipped with a unit which is removably installable in the main assembly of the apparatus.

There have been known various image forming apparatuses such as a printing machine, a facsimile machine, a copying machine, and a multifunction machine which form an image on recording medium with the use of an image formation process. Some of these machines are structured so that one or more units in which an image bearing component, and/or means for processing the image bearing component, are integrally disposed, are removably installable in the main assembly of the apparatus. As for the unit, there are a development unit which primarily comprises a development sleeve, a drum unit which primarily comprises a photosensitive drum, and the like. The development unit, drum unit, and/or the like, and an image forming apparatus which employs the development unit, drum unit, and/or the like, are structured so that the development unit, drum unit, and/or the like are removably installable in the main assembly of the apparatus (Japanese Laid-open Patent Application No. 2010-271408. Further, the entrance (opening) of the main assembly of the image forming apparatus, through which these units are inserted into, or extracted from, the main assembly, is provided with a door which can be opened or closed by a user (operator of apparatus).

The development unit and drum unit are disposed in the main assembly of an image forming apparatus so that after the completion of their installation into the main assembly, the development sleeve and photosensitive drum are positioned close to each other with the provision of a preset amount of distance between the peripheral surface of the development sleeve and the peripheral surface of the photosensitive drum, because unless the development sleeve and photosensitive drum are disposed so that the peripheral surface of the development sleeve opposes the peripheral surface of the photosensitive drum with the presence of a minute gap (which sometimes called "SD gap") between them, it is possible that the image forming apparatus will form defective images such as images which are not uniform in density. One of the solutions to this problem is to increase in diameter the bearings which bear the photosensitive drum or the bearings which bear the development sleeve, by an amount equal to the SD gap, so that it is ensured that as the bearings for the photosensitive drum and the bearings for the development sleeve are placed in contact with each other, one for one, the preset SD gap is provided between the peripheral surface of the photosensitive drum and the peripheral surface of the development sleeve. Further, in order to ensure that the bearings are kept in contact with corresponding bearings, the development unit, for example, is kept pressed against the drum unit.

In the case of an image forming apparatus in which a unit (units) is removably installable, it is possible that when a unit is installed into the main assembly of the apparatus, it will fail to be completely installed. In the case of a conventional image forming apparatus, even when a unit failed to be completely installed, it was pushed into the main assembly by the abovementioned door as the door was closed. That is, even when the bearings were in contact with the corresponding bearings, the unit was pushed into the main assembly by the door as the door was closed. Therefore, the bearings are forced to rub against each other, becoming sometimes damaged. As the bearings are damaged, they fail to provide the preset amount of SD gap, and therefore, it is possible that image defects will occur.

SUMMARY OF THE INVENTION

Thus, the primary object of the present invention is to provide an image forming apparatus which can prevent the problem that as the door of the apparatus is closed when a unit is installed into the main assembly of the apparatus, the unit is pushed into the main assembly by the door.

According to an aspect of the present invention, there is provided an image forming apparatus comprising an image bearing member unit detachably mountable to a main assembly of said image forming apparatus, said image bearing member unit includes an image bearing member; a developing unit including a developer carrying member configured to form a toner image on said image bearing member, said developing unit detachably mountable to said image forming apparatus; an accommodating portion configured to accommodate said image bearing member unit and said developing unit and provided with an inserting opening through which said developing unit is insertable; a rotatable openable member configured to open and close said inserting opening; a pressing mechanism configured to press and release said image bearing member unit and said developing unit relative to each other in interrelation with an opening and closing operation of said openable member; and a contact surface provided on said openable member, said contact surface is capable of being contacted by an upstream end portion of one of said units with respect to an inserting direction of said one of said units into said image forming apparatus, when said openable member is closed in a state that the upstream end portion is projected out of said accommodation opening by a predetermined amount beyond a predetermined position, wherein an angle formed between a normal line of said contact surface and the inserting direction in a downstream side is not less than 90 degrees.

Further features of the present invention will become apparent from the following description of exemplary embodiments with reference to the attached drawings.

Figure 10:
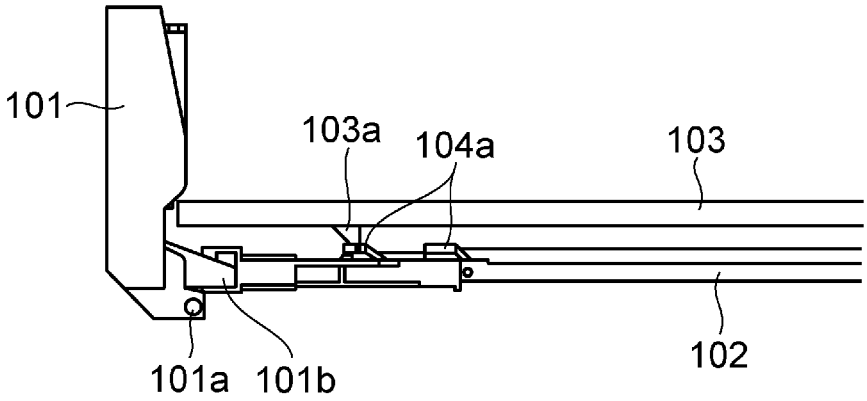
Figure 10:
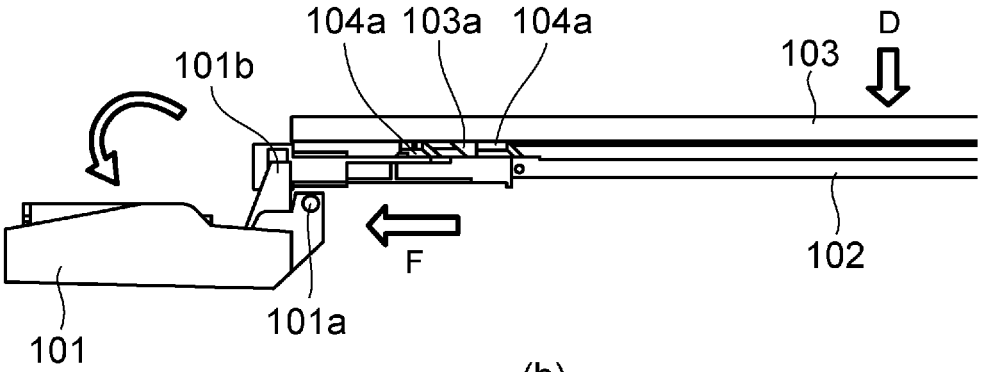

Parts (a) and (b) FIG. 10 illustrate the operation for placing the drum unit in contact with the development unit, or separating the drum unit from the development unit; Parts (a) and (b) relate to when the door is open and closed, respectively.

Figure 11:
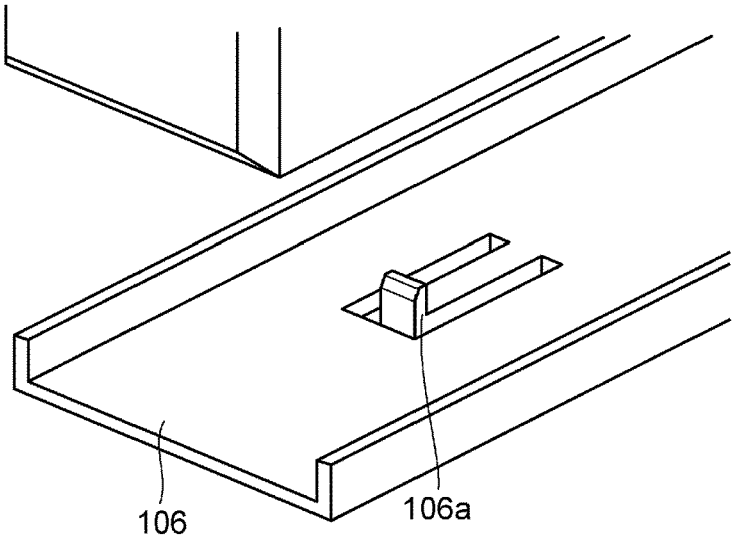

FIG. 11 is an enlarged view of a part of the drum unit rail.

Figure 12:
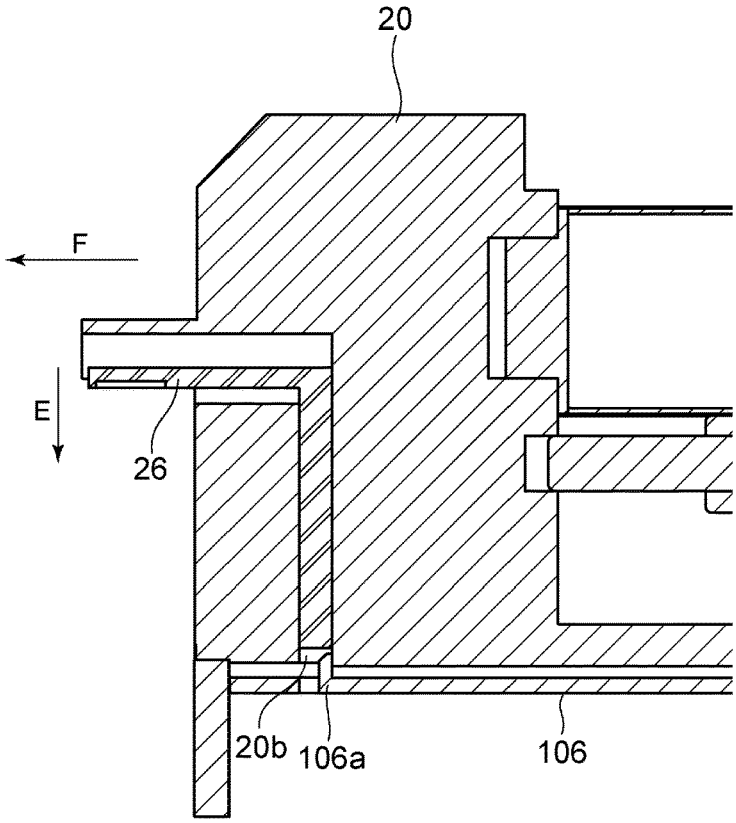

FIG. 12 is a schematic drawing which shows the state of the drum unit after the proper installation of the unit into the main assembly of the apparatus.

Figure 13:
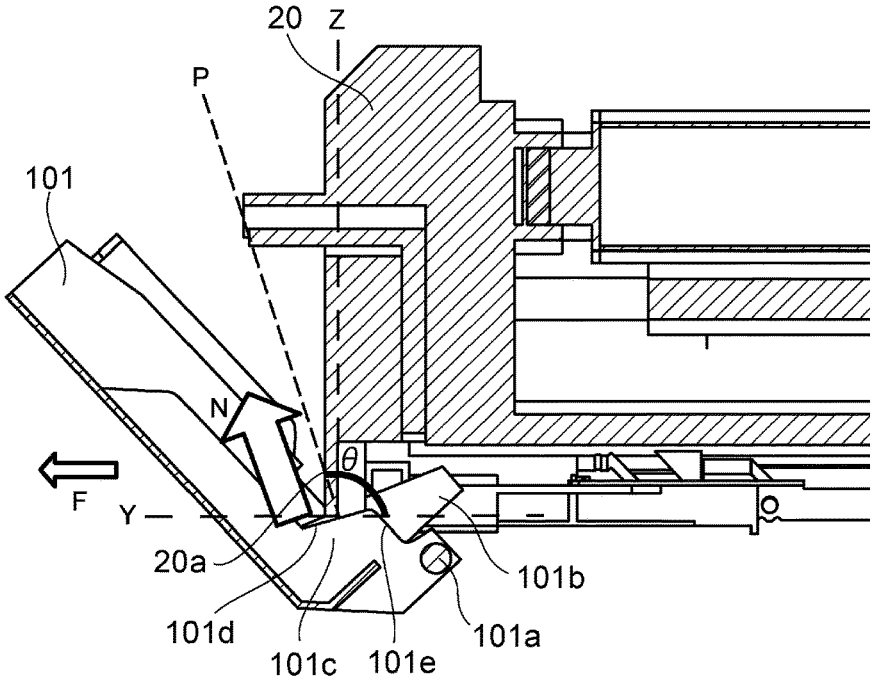

FIG. 13 is a schematic drawing for describing the rib.

Figure 14:
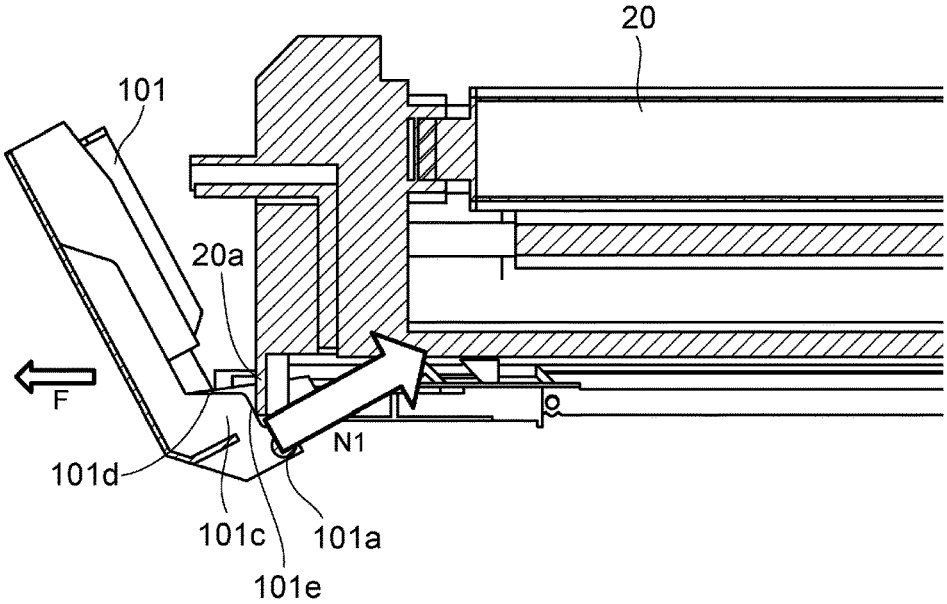

FIG. 14 is a drawing for describing the force to which the rib is subjected when the drum unit is not protrusive by a sufficient amount.

Figure 15:
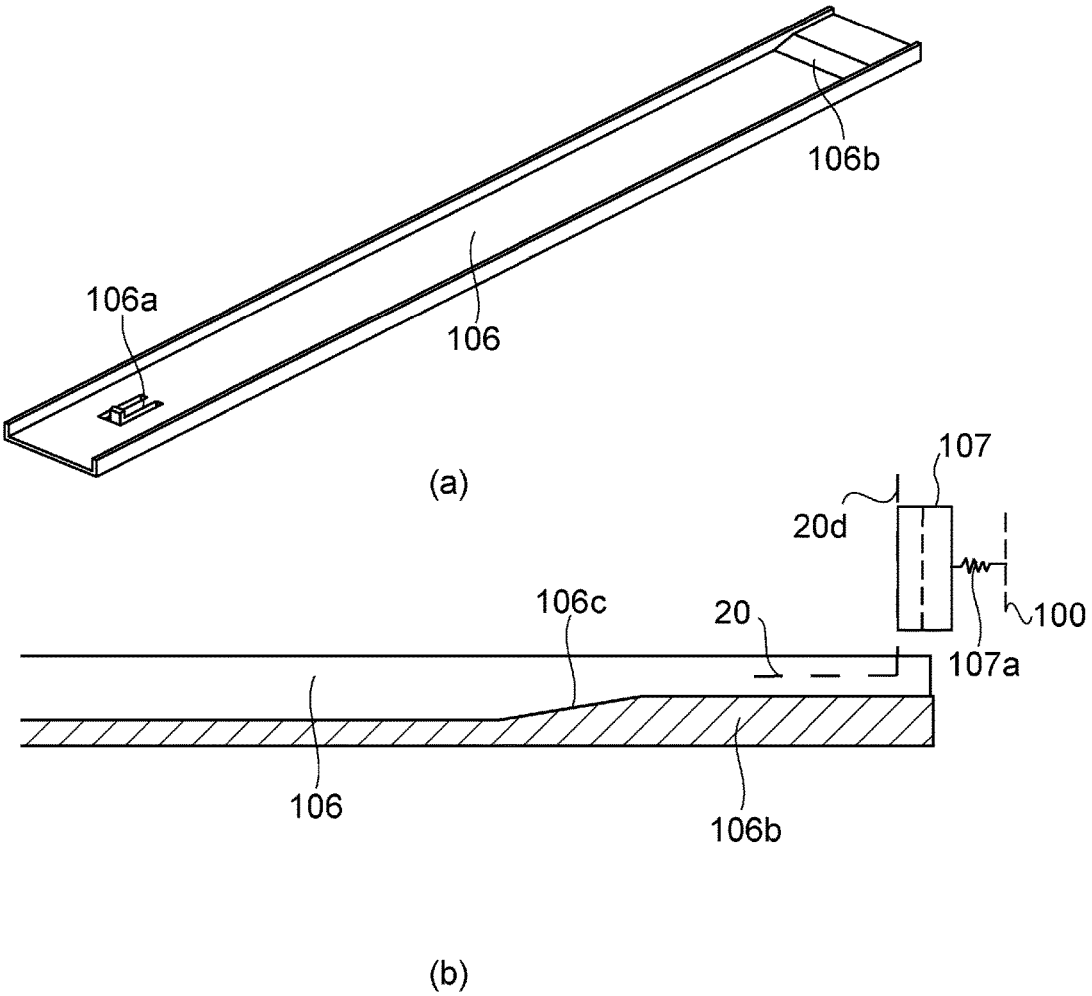

FIG. 15 is a drawing of the entirety of the drum unit rail; part (a) is a perspective view of the drum unit rail, and part (b) is a sectional view of a part of the drum unit rail, which has the slanted surface.

Figure 16:
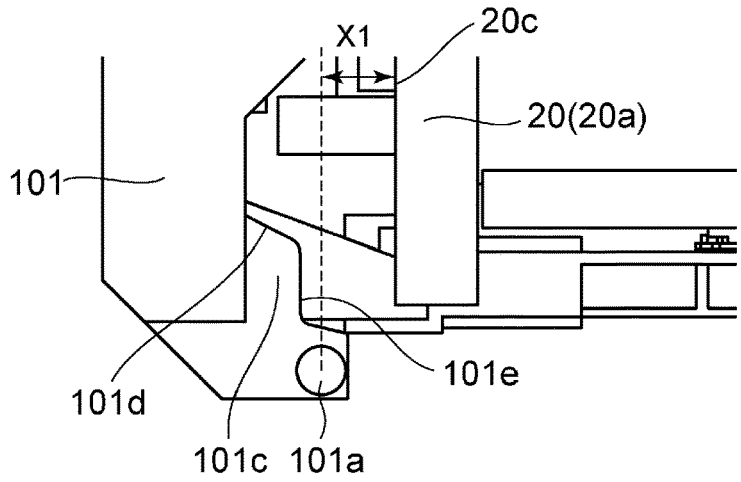
Figure 16:
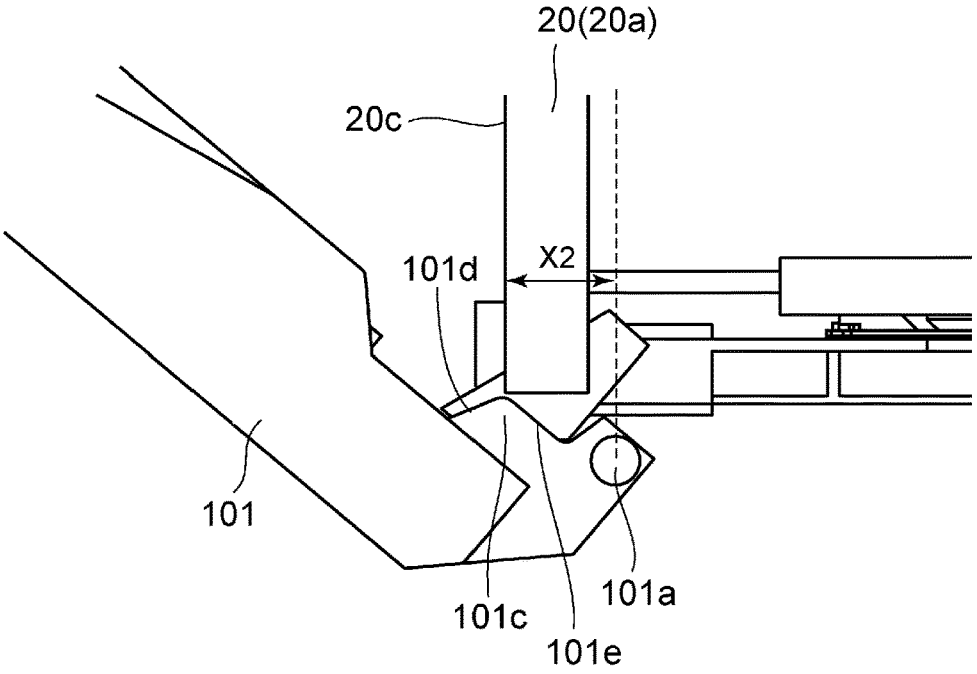

FIG. 16 is a drawing for describing the amount by which the drum unit protrudes; part (a) relates to when the door is closed, and part (b) relates to when the drum unit is protrusive by a sufficient amount.

Figure 17:
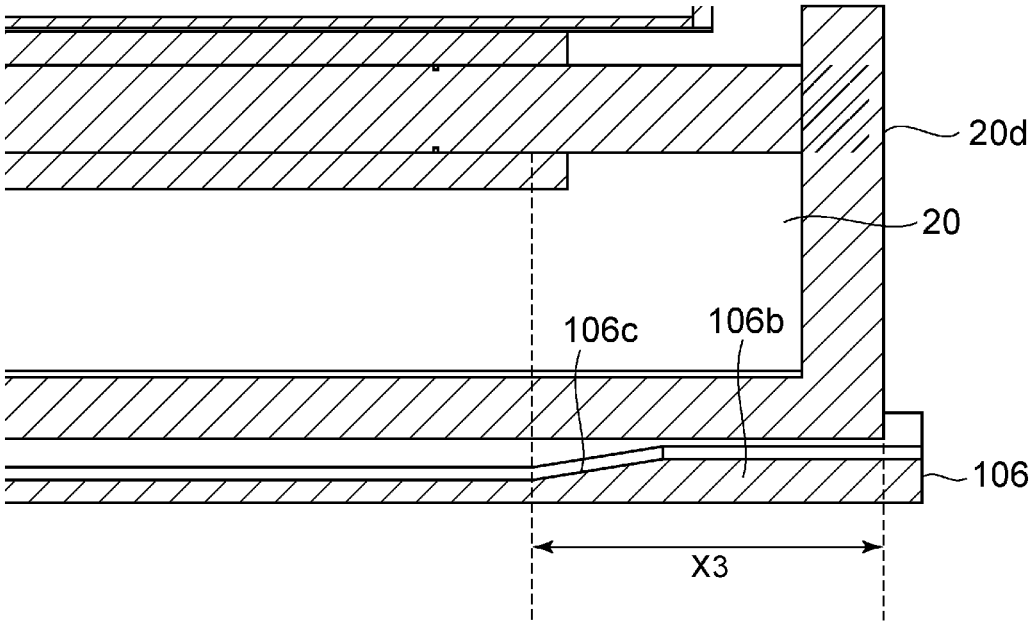

FIG. 17 is a schematic drawing of the drum unit and drum unit rail after the complete installation of the drum unit into the main assembly.

DESCRIPTION OF THE EMBODIMENTS

Figure 1:
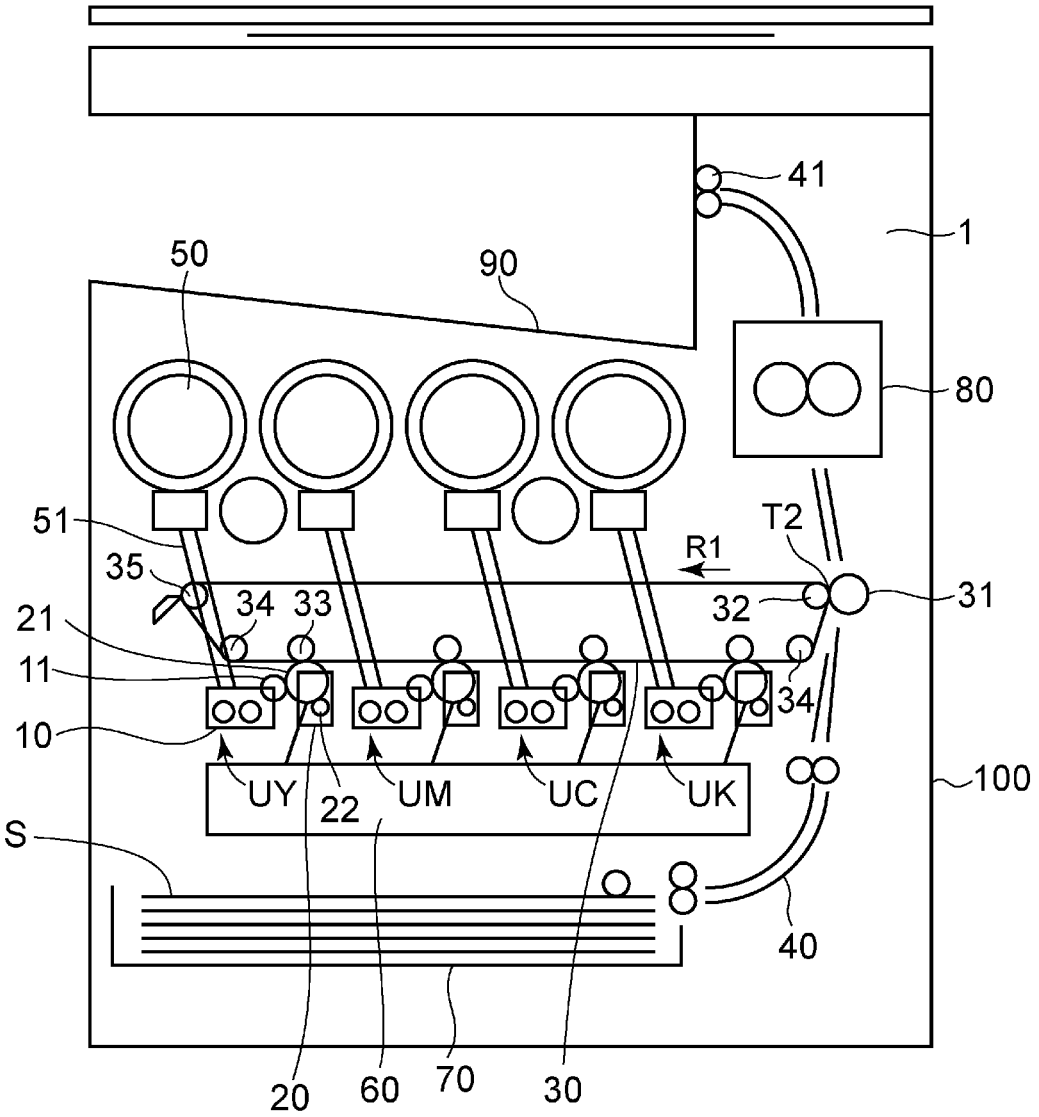
FIG. 1 is a schematic drawing of the image forming apparatus in one of the preferred embodiments of the present invention, and shows the general structure of the apparatus.
Figure 2:
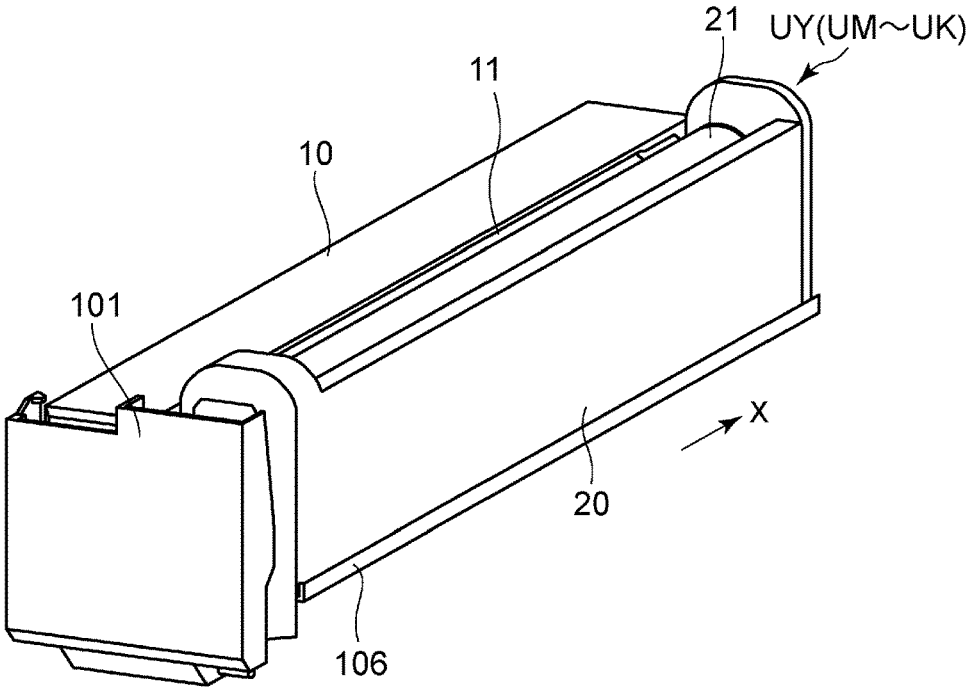
FIG. 2 is a perspective view of the door and image forming section of the image forming apparatus.

Hereinafter, one of the preferred embodiments of the present invention is described in detail with reference to appended drawings. To begin with, referring to FIGS. 1 and 2, the image forming apparatus 1 in this embodiment is described. FIG. 1 is a schematic drawing of the image forming apparatus 1 in accordance with the present invention, more specifically, a color image forming apparatus which uses an electrophotographic image forming method. It shows the general structure of the apparatus. FIG. 2 is a perspective view of the door and image forming section of the apparatus.

[Image Forming Apparatus]

Shown in FIG. 1 is an image forming apparatus of the so-called intermediary transfer type, and also, of the so-called tandem type. It has: four image forming sections UY, UM, UC and UK, which are different in the color of the monochromatic images (yellow (Y), magenta (M), cyan (C) and black (K)) they form, respectively, and are disposed in the main assembly of the apparatus; and an intermediary transfer belt 30 which is disposed in the main assembly in such a manner that it opposes the four image forming sections. However, this embodiment is not intended to limit the present invention to four in terms of the number of monochromatic toner images the apparatus forms, and also, the order in which the image forming sections are aligned. Each of these image forming sections UY, UM, UC and UK is provided with a development unit 10 and drum unit 20. Referring to FIG. 2, each of the image forming sections Y (UY-UK) comprises a combination of the development unit 10 and drum unit 20.

First, the process for conveying recording medium through the image forming apparatus 1 is described. The image forming apparatus 1 is provided with a recording medium storage 70 (cassette) in which multiple sheets S of recording medium are stored in layers. Each sheet S of recording medium is moved out of the recording medium storage 70 (cassette) into a recording medium conveyance passage 40 in synchronism with the image formation timing. As the sheet S is moved out of the cassette 70, it is corrected in attitude and conveyance timing, and then, is sent to, and conveyed through, a secondary transferring section T2, which is a transfer nip formed by a pair of mutually opposing transfer rollers 31 (outside roller) and 32 (inside roller). As the sheet S is conveyed through the secondary transferring section T2, it is subjected to a preset amount of pressure, and a preset amount of electrostatic load (bias). Thus, the toner images, different in color, are adhered to the surface of the sheet S.

Next, the image formation process which is carried out in synchronism with the timing with which the above-described process for conveying a sheet S of recording medium to the secondary transferring section T2 is described. First, the image forming sections UY-UK are described. However, they are basically the same in structure although they are different in the color of the toner image they form. Therefore, the yellow image forming section UY is described as the one which represents all the image forming sections. The image forming section UY is made up of the development unit 10 which primarily comprises a development sleeve 11, and the drum unit 20 which primarily comprises a photosensitive drum 21 and charge roller 22. The development unit 10 and drum unit 20 are described later.

As the photosensitive drum 21 is rotationally driven, its peripheral surface is uniformly charged by the charge roller 22. Then, an electrostatic latent image is formed on the uniformly charged portion of the peripheral surface of the photosensitive drum 21, by an exposing unit 60, based on signals which are in accordance with the information of an image to be formed. Then, the electrostatic latent image formed on the photosensitive drum 21 is developed into a visible image by the toner on the development sleeve 11. Then, the visible image (developed latent image) is subjected to a preset amount of pressure and a preset amount of electrostatic bias (load) by a primary transferring device 33 which is disposed so that it opposes the image forming section UY with the presence of the intermediary transfer belt 30 between the primary transferring device 33 and image forming section UY. Thus, the toner image on the photosensitive drum 21 is transferred (primary transfer) onto the intermediary transfer belt 30. As for the developer, two-component developer which is a mixture of toner and magnetic carrier is used. The developer is delivered to the development unit 10 from a toner bottle 50 set in the image forming section UY, through a toner delivery passage 51, by an unshown toner delivery unit.

The intermediary transfer belt 30 is an endless belt. It is suspended and kept tensioned by various rollers, more specifically, the secondary transfer roller 32 (inside roller), an idler roller 34, a tension roller 35, etc. It is circularly driven in the direction indicated by an arrow mark R1 in the drawing. By the way, the secondary transfer roller 32 (inside roller) doubles as a driver roller for driving the intermediary transfer belt 30. The image formation process is carried out in each of the image forming sections UY-UK with such a timing that the four monochromatic toner images formed in the image forming sections UY-UK, one for one, are sequentially layered on the intermediary transfer belt 30 as they are transferred onto the intermediary transfer belt 30, effecting thereby a full-color toner image on the intermediary transfer belt 30. Then, the full-color toner image is conveyed to the secondary transferring section T2.

Through the above-described recording medium conveyance process and image formation process, the sheet S of recording medium and full-color toner image arrive at the same time, at the secondary transferring section T2, in which the full-color toner image is transferred (secondary transfer) onto the sheet S. Thereafter, the sheet S is conveyed to a fixing device 80, in which the full-color toner image on the sheet S is subjected to a preset amount of pressure and a preset amount of heat. Thus, the toner image melts, and becomes fixed to the sheet S as it cools down. After the fixation of the full-color toner image to the sheet S, the sheet S is discharged onto a delivery tray 90 by a pair of discharge rollers 41.

Generally speaking, by the way, the development unit 10 and drum unit 20 are shorter in life span than other image processing means (fixing device, for example) of the image forming apparatus 1. Thus, they need to be replaced as necessary. Therefore, the front side (which corresponds to a front surface of the sheet of paper on which FIG. 2 is drawn) of each of image forming sections UY-UK of the image forming apparatus 1 is provided with an entrance (unshown) through which the development unit 10 and drum unit 20 can be inserted into, or pulled out of, the image forming sections U. Further, referring to FIG. 2, the entrance of each image forming section U of the image forming apparatus 1 is provided with a door which can be opened or closed by a user (operator).

The development unit 10 and drum unit 20 are independently installable in the main assembly 100 of the image forming apparatus 1. The direction in which the development unit 10 is inserted into the apparatus main assembly 100, and the direction in which the drum unit 20 is inserted into the apparatus main assembly 100, are parallel to the rotational axes of the development sleeve 11 and photosensitive drum 21, respectively. The development unit 10 and drum unit 20 are operated by the driving force transmitted thereto from the apparatus main assembly 100 in which they are installed, and the electric power supplied thereto by the main assembly 100. In order to transmit driving force to the development unit 10 and drum unit 20 from the apparatus main assembly 100, and also, to supply the development unit 10 and drum unit 20 with the electric power from the apparatus main assembly 100, the apparatus main assembly 100 is provided with couplings 107 (part (b) of FIG. 15 which will be described later), which will be between the development unit 10 and apparatus main assembly 100, and between the drum unit 20 and apparatus main assembly 100.

[Development Unit]

Figure 3:
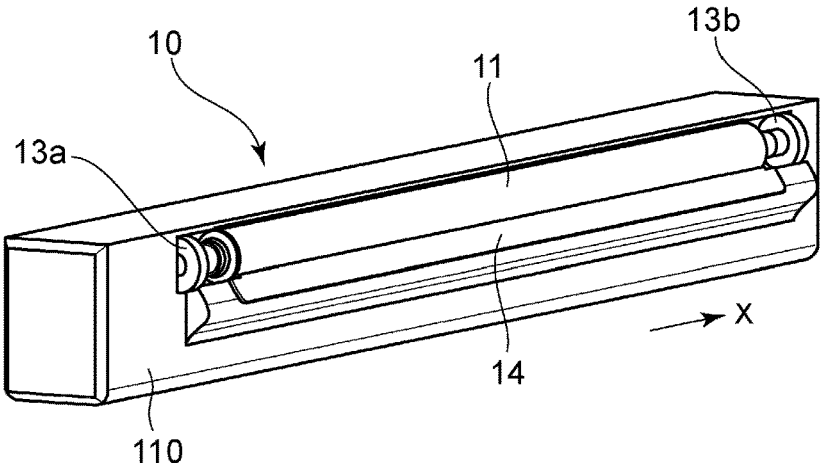
FIG. 3 is a perspective view of the development unit.
Figure 4:
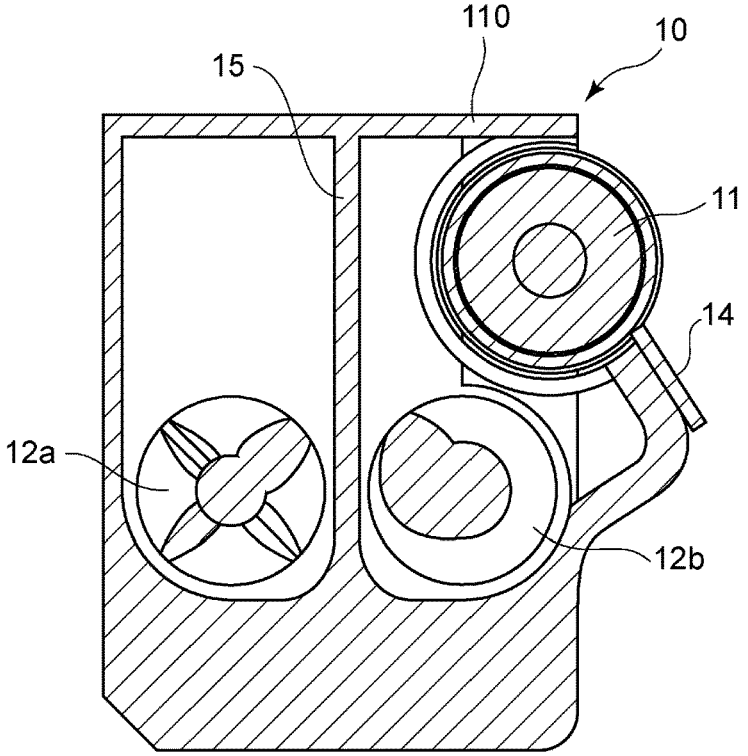
FIG. 4 is a sectional view of the development unit.

Next, referring to FIGS. 3 and 4, the development unit 10 is described. Referring to FIG. 3, the development unit 10 has: a housing 110; the development sleeve 11 which is rotatably supported in the housing 110; and a cleaning blade 14. The development sleeve 11, which is a developer bearing component, is rotatably supported by a pair of bearings 13*a* and 13*b*, disposed at the front and rear ends, respectively, of the housing 110 in terms of the development unit insertion direction (indicated by arrow mark X in FIG. 3). By the way, the bearings 13*a* and 13*b*, which may be referred to as the second bearing sections, double as gap forming components, as will be described later. The bearings 13*a* and 13*b* (second bearing sections), which play a role of the second contacting portion are pivotally movable relative to the housing 110.

The housing 110 stores two-component developer (which hereafter will be referred to simply as developer) which is a mixture of nonmagnetic toner and magnetic carrier. Referring to FIG. 4, the interior of the housing 110 has two chambers (development chamber and stirring chamber) separated by a partitioning wall 15. The development chamber and stirring chamber are in connection to each other at both of their lengthwise ends. There are a conveyance screw 12*a* and a stirring screw 12*b* in the development chamber and stirring chamber, respectively, being rotatably supported. The conveyance screw 12*a* and stirring screw 12*b* are disposed next to each other in parallel so that their rotational axes become parallel to each other. As the conveyance screw 12*a* and stirring screw 12*b* are driven, the developer is circulated alternately through the development chamber and stirring chamber. The development sleeve 11 is supplied with the developer from the development chamber, and conveys the developer. The cleaning blade 14 is disposed in the adjacencies of the peripheral surface of the development sleeve 11, and forms a thin layer of the developer on the peripheral surface of the development sleeve 11. The development sleeve 11 supplies the photosensitive drum 21 with the developer, in the development position where the development sleeve 11 opposes the photosensitive drum 21. Consequently, the electrostatic latent image formed on the peripheral surface of the photosensitive drum 21 is developed.

Further, the housing 110 is provided with a developer entrance through which the housing 110 receives the developer from the toner bottle 50, and a shutter which exposes the developer entrance or keeps the developer entrance shut. Moreover, the housing 110 is provided with a developer exit through which the developer is discharged from the housing 110 after the developer is deteriorated by image formation, and a shutter which exposes the exit or keeps the exit shut. When the development unit 10 is pulled out of the apparatus main assembly 100, the developer entrance shutter and developer exit shutter keep the developer entrance and developer exit shut, respectively, to prevent the developer in the housing 110 from leaking out of the development unit 10. On the other hand, as the development unit 10 is installed into the apparatus main assembly 100, the developer entrance shutter and developer exit shutter open to expose the developer entrance and developer exit to make it possible for the housing 110 to be supplied with the developer, and also, to discharge the deteriorated developer, respectively. The developer entrance shutter and developer exit shutter are kept pressured in the direction to keep the developer entrance and developer exit shut by shutter springs.

[Drum Unit]

Figure 5:
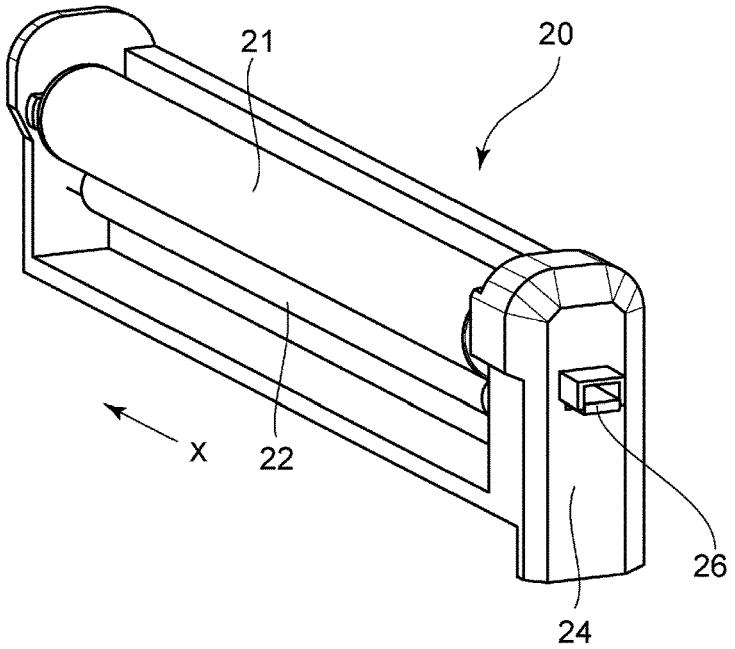
FIG. 5 is a perspective view of the drum unit.
Figure 6:
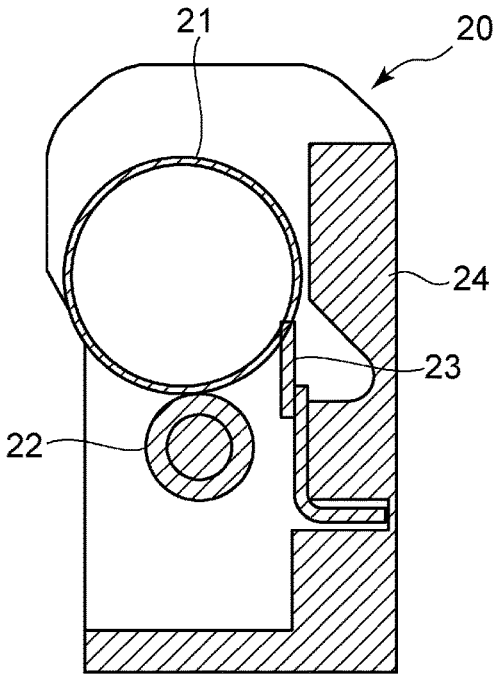
FIG. 6 is a sectional view of the drum unit.
Figure 7:
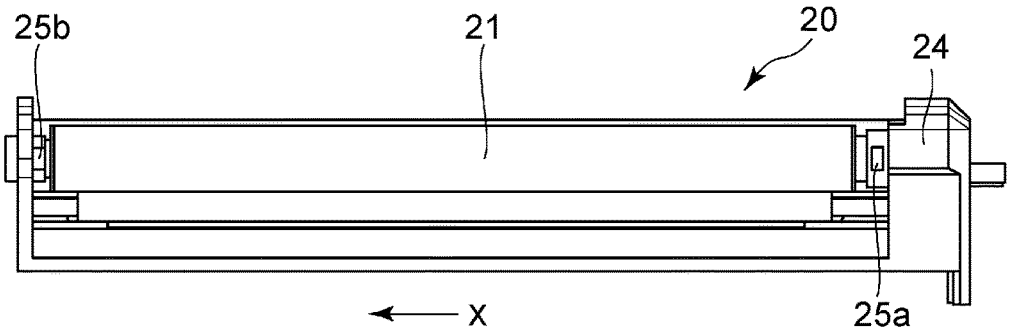
FIG. 7 is a side view of the drum unit.

Next, referring to FIGS. 5 to 7, the drum unit 20 which is an image bearing component unit is described. Referring to FIGS. 5 and 6, the drum unit 20 has: the photosensitive drum 21; the charge roller 22; and a housing 24 which is in the form of a boxy container, and by which the photosensitive drum 21 and charge roller 22 are rotatably supported. The housing 24 is provided with an opening through which the photosensitive drum 21 is partially exposed from the housing 24 so that as the drum unit 20 is installed into the apparatus main assembly 110, the photosensitive drum 21 directly opposes the development sleeve 11 of the development unit 10. As the photosensitive drum 21 is rotationally driven, the charge roller 22 uniformly charges the peripheral surface of the photosensitive drum 21.

The photosensitive drum 21 which is an image bearing component is in connection to the driving force source (unshown) of the apparatus main assembly 100. It is rotated by the driving force transmitted thereto from the driving force source. As for the charge roller 22, it is kept pressed upon the peripheral surface of the photosensitive drum 21, and is rotated by the rotation of the photosensitive drum 21. After the charging of the photosensitive drum 21, an electrostatic latent image is formed on the photosensitive drum 21 by an exposing unit 30 with which the image forming apparatus 100 is provided. Then, the electrostatic latent image on the photosensitive drum 21 is developed into a visible image (formed of toner) by the toner borne on the development sleeve 11. Then, the toner image formed on the photosensitive drum 21 is transferred onto recording medium such a sheet of paper. Next, referring to FIG. 6, the drum unit 20 has a drum cleaning blade 23, which removes from the photosensitive drum 21, the transfer residual toner, that is, the toner which was not transferred, and therefore, is remaining on the photosensitive drum 21 after the transfer.

Next, referring to FIG. 7, the photosensitive drum 21 is rotatably supported by a pair of bearings 25*a* and 25*b* as the first bearings, located at the front and rear ends, respectively, of the drum unit 20, in terms of the drum unit insertion direction (indicated by arrow mark X in drawing). The bearings 25*a* and 25*b* double as gap forming components which are placed in contact with the pair of bearings 13*a* and 13*b* which bear the axle of the development sleeve 11 when the drum unit 20 is in the apparatus main assembly 100. The bearings 25*a* and 25*b* make up the first areas of contact (first bearings), and are pivotally movable relative to the housing 24.

Regarding the placement of the bearings 25*a* and 25*b* in contact with the bearings 13*a* and 13*b*, respectively, because the development unit 10 having the bearings 13*a* and 13*b* is pressed toward the drum unit 20, the bearings 13*a* and 13*b* come into contact with the bearings 25*a* and 25*b*, respectively. However, if the bearings 13*a* and 13*b* are kept in contact with the bearings 25*a* and 25*b* when the drum unit 20 is inserted into, or pulled out of, the apparatus main assembly 100, it is possible that the bearings 13*a* and 13*b*, and/or bearings 25*a* and 25*b* will sustain frictional scars. As for means for preventing the occurrence of this problem, it is possible to structure the apparatus main assembly 110, development unit 10, and drum unit 20 so that the drum unit 20 can be inserted into, or pulled out of, the apparatus main assembly 100 only after the development unit 10 and drum unit 20 are separated from each other to separate the bearings 13*a* and 13*b* from the bearings 25*a* and 25*b*, respectively. With the image forming apparatus 1 being structured as described above, when the drum unit 20 is inserted into, or pulled out of, the apparatus main assembly 100, a gap which is large enough to prevent the bearings 13*a* and 13*b* from coming into contact with the bearings 25*a* and 25*b*, respectively, is provided, making it unlikely for the bearings 13*a*, 13*b*, 25*a* and 25*b* to be damaged when the drum unit 20 is inserted into, or pulled out of, the apparatus main assembly 100. In this embodiment, therefore, the image forming apparatus 1 was structured so that as the door 101 is opened, the drum unit 20 is separated from the development unit 10 by the movement of the door 101, and also, that as the door 101 is closed, the development unit 10 is placed in contact with the drum unit 20 by the movement of the door 101. Hereafter, referring from FIG. 8 through part (b) of FIG. 10, the mechanism for placing the development unit 10 in contact with the drum unit 20, or separating the development unit 10 from the drum unit 20, is described. By the way, this mechanism will be referred to as "contact-separation mechanism" hereafter.

[Contact-Separation Mechanism]

Figure 8:
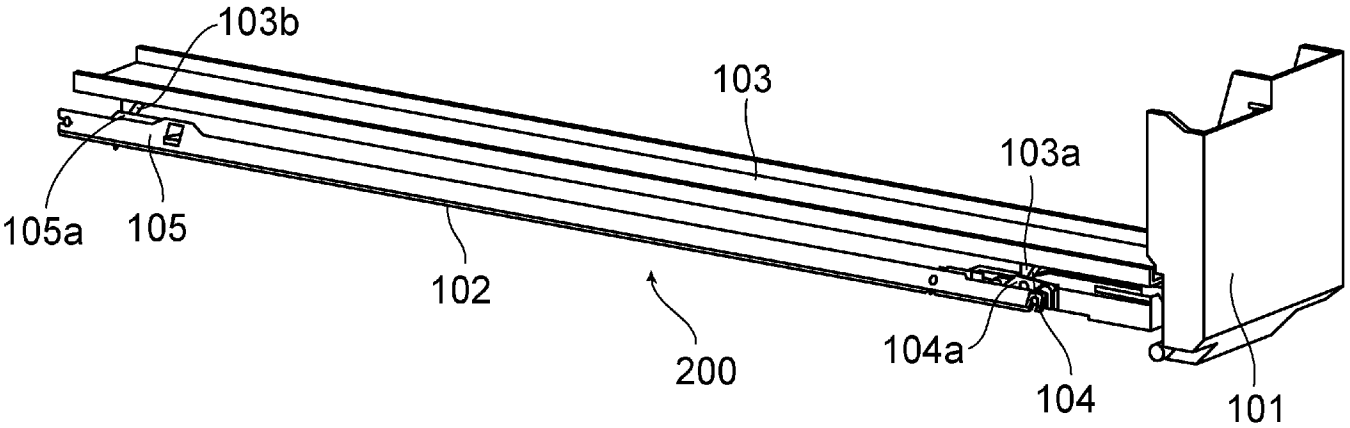
FIG. 8 is a perspective view of the mechanism which places the drum unit in contact with the development unit, or separates the drum unit from the development unit.
Figure 9:
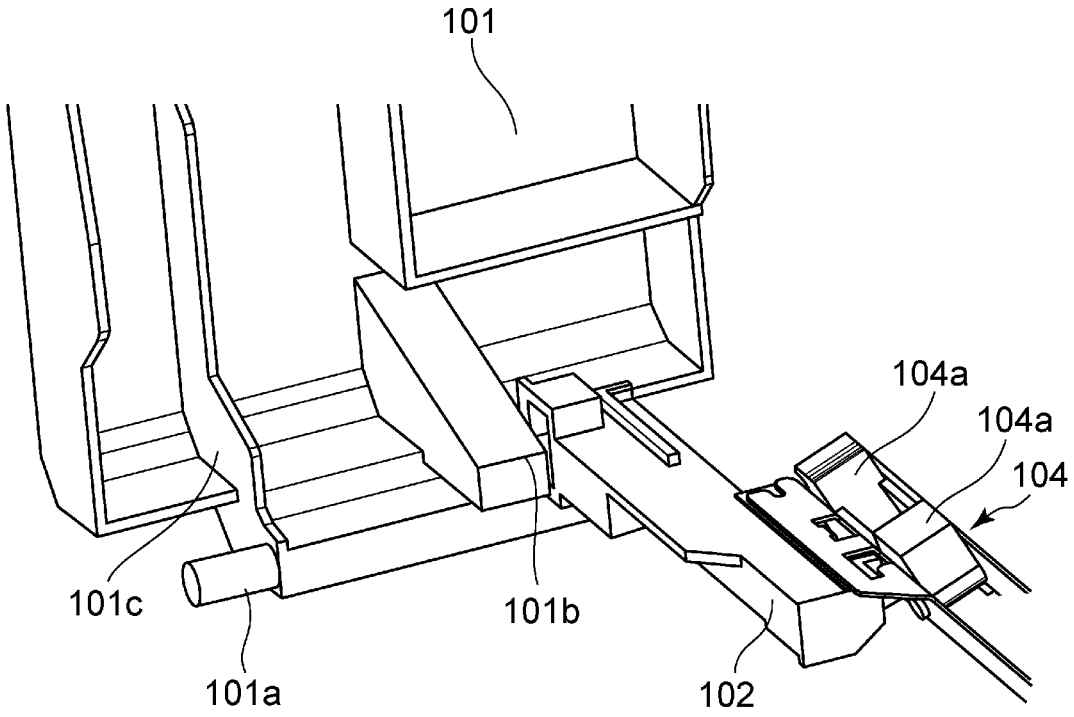
FIG. 9 is an enlarged view of a part of the mechanism which places the drum unit in contact with the development unit, or separates the drum unit from the development unit.

Referring to FIG. 8, the contact-separation mechanism 200 has a separation linkage 102 and a development unit rail 103. The development unit rail 103 has a guiding surface which extends in the insertion direction (lengthwise direction). It can hold the development unit 10 so that the development unit 10 is allowed to slide on the rail 103. Thus, as the development unit 10 is inserted into the apparatus main assembly 100, it engages with the development unit rail 103, and slides on the rail 103, being thereby guided into the apparatus main assembly 100. The contact-separation mechanism 200 is also provided with a separation linkage 102, which is on the underside of the rail 103, and extends in the insertion direction (lengthwise direction), along the rail 103. Further, the contact-separation mechanism 200 is provided with a pair of pressure application levers 104 and 105, which are at the rear (downstream in terms of insertion direction) and front (upstream in terms of insertion direction) ends, respectively. The pressure application levers 104 and 105 having engaging portions 104*a* and 105*a*, respectively, which have such a shape that in terms of the rear-to-front direction, the closer to the door 101, the greater the engaging portions 104*a* and 105*a* in upward protrusion (as shown in FIG. 9, which will be described later.). In comparison, the rail 103 has a pair of engaging sections 103*a* and 103*b*, which can engage with the engaging sections 104*a* and 104*b* of the pressure application levers 104 and 105, respectively.

As described above, the door 101 is at the outward end of the developer entrance (unshown) of the apparatus main assembly 100, and is pivotally movable about a shaft 101*a* (pivot) to be closed to take a closed position in which it covers the upstream end of the development unit 10 in terms of the insertion direction, or to be opened to take an open position in which it exposes the upstream end of the development unit 10 in terms of the insertion direction. Referring to FIG. 9, the door 101 is in connection to the separation linkage 102 through a linkage 101*b*. As the door 101 is opened, the separation linkage 102 is moved frontward in terms of the development unit insertion direction by the movement of the door 101, whereas as the door 101 is closed, the separation linkage 102 is moved rearward in terms of the insertion direction by the movement of the door 101. These movements of the separation linkage 102 change the manner of engagement between the engaging sections 104*a* and 105*a* of the pressure application levers 104 and 105, and the engaging sections 103*a* and 103*b* of the development unit rail 103.

In this embodiment, when the door 101 is remaining closed (closed state) as shown in part (a) of FIG. 10, the engaging section 104*a* (engaging section 105*a* is not shown in part (a) of FIG. 10), and the engaging section 103*a* (engaging section 103*b* is not shown in part (a) of FIG. 10) remains disengaged. When the engaging sections 104*a* and 105*a* are not in engagement with the engaging sections 103*a* and 103*b*, respectively, the development unit rail 103 is pushed upward (in drawing) (opposite direction from surface with which bottom of apparatus main assembly 100 is in contact), that is, in the direction to separate from the separation linkage 102. That is, the development unit 10 is positioned so that the distance between the peripheral surface of the development sleeve 11 and the peripheral surface of the photosensitive drum 21 becomes smallest. In this case, the above-described bearings 13*a* and 13*b* for the development sleeve 11 remain in contact with the bearings 25*a* and 25*b* for the photosensitive drum 21. Therefore, it is ensured that the development unit 10 is positioned to provide the preset amount of SD gap.

On the other hand, as the door 101 is opened as shown in part (b) of FIG. 10 (when the door 101 is open), the engaging sections 104*a* and 105*a* engage with the engaging sections 103*a* and 103*b*, respectively (engaging sections 104*a* and 105*b* remain engaged with engaging sections 103*a* and 103*b*). Further, as the engaging sections 104*a* and 105*b* are made to engage with the engaging sections 103*a* and 103*b*, respectively, the development unit rail 103 is moved downward (toward surface with which bottom surface of apparatus main assembly is in contact) so that the development unit rail 102 is placed closer to the separation linkage 102 than when the engaging sections 104*a* and 105*a* are in contact with the engaging sections 104*a* and 105*a*; when engaging sections 104*a* and 105*a* are in engagement with engaging sections 103*a* and 103*b*, the distance between the development unit rail 102 and separation linkage 102 is smallest. That is, referring to part (b) of FIG. 10, as the closed door 101 is opened, the linkage section 101*b* of the door 101 moves frontward (indicated by arrow mark F in drawing) in terms of the development unit insertion direction. Therefore, the separation linkage 102 moves frontward in terms of the development unit insertion direction. As the separation linkage 102 moves frontward, the engaging section 103*a* and 103*b* diagonally slide downward along the engaging sections 104*a* and 105*a*. Consequently, the engaging sections 103*a* and 103*b* engage with the engaging sections 104*a* and 105*b*. As the development unit rail 102 moves downward (indicated by arrow mark D in drawing, the drum unit 20 becomes separated from the drum unit 20. Thus, the bearings 13*a* and 13*b* of the development sleeve 11 become separated from the bearings 25*a* and 25*b* of the photosensitive drum 21, respectively.

As the development unit rail 102 is upwardly or downwardly moved in the vertical direction by the opening or closing of the door 101, the development unit 10 is placed in contact with, or separated from the drum unit 20. The development unit 10 moves between the first position in which the bearings 13*a* and 13*b* of the development sleeve 11 remain in contact with the bearings 25*a* and 25*b* of the photosensitive drum 21, and the second position in which the bearings 13*a* and 13*b* remain separated from the bearings 25*a* and 25*b*.

Next, referring to FIGS. 11 and 12, the installation of the drum unit 20 into the apparatus main assembly 100 is described. The drum unit 20 is installed into the apparatus main assembly 100 by being pushed into the apparatus main assembly 100 through the unshown entrance. In order to make it easier for the drum unit 20 to be disposed in a preset position (which hereafter may be referred to as "installation position"), a drum unit rail 106 which is a guiding component is provided in the apparatus main assembly 100. The drum unit rail 106 has a guiding surface which extends in the direction (lengthwise direction) in which the drum unit 20 is inserted into, or pulled out of, the apparatus main assembly 100. Thus, as the drum unit 20 is inserted into, or pulled out of, the apparatus main assembly 100, the drum unit 20 slides on the drum unit rail 106. That is, as the drum unit 20 is inserted into the apparatus main assembly 100, it slides on the guiding surface of the drum unit rail 106, being thereby guided into the apparatus main assembly 100.

Referring to FIG. 11, the drum unit rail 106 is provided with a positioning section 106*a*, which is on the front side of the drum unit rail 106 and protrudes above the guiding surface. As the drum unit 20 is inserted into the apparatus main assembly 100, the positioning section 106*a* which also is an engaging section is pushed downward by the drum unit 20. Thus, it retracts below the guiding surface by elastically deforming. Referring to FIG. 12, on the other hand, the drum unit 20 is provided with a hole 20*b* which opens at the bottom surface of the drum unit 20. Thus, as the drum unit 20 is inserted into the installation position, the positioning section 106*a*, which had retracted below the guiding surface, protrudes (engage) into the hole 20*b*, accurately positioning the drum unit 20 relative to the apparatus main assembly 100. That is, as the positioning section 106*a* engages into the hole 20*b*, the drum unit 20 is prevented from moving frontward in terms of the development unit insertion direction; the drum unit 20 is prevented from being jettisoned from the apparatus main assembly 100. When the drum unit 20 is in the installation position, it is under the pressure generated by a coupling spring 107*a* (part (b) of FIG. 15 which will be described later) in the frontward direction in terms of the insertion direction. Thus, in order to keep the drum unit 20 in the preset position in the apparatus main assembly 100 against the resiliency of the coupling spring 107*a*, the drum unit rail 106 is provided with the positioning section 106*a*, and the drum unit 20 is provided with the hole 20*b*.

Also referring to FIG. 12, the drum unit 20 is provided with a through hole 20*b*, one end of which is open at the bottom surface of the drum unit 20. The through hole 20*b* extends through the drum unit 20 and opens at the front surface in terms of the insertion direction. Further, the drum unit 20 is provided with a releasing component 26, which is in the through hole 20*b*. When the drum unit 20 is in the installation position, one end of the releasing component 26 remains protrusive from the front surface of the drum unit 20, whereas the other end remains in contact with the positioning section 106*a* which is in the hole through 20*b*. Thus, as the front side end of the releasing component 26 is pressed downward (indicated by arrow mark E in drawing), the other end of the releasing component 26 pushes down the positioning section 106*a*. Consequently, the positioning section 106*a* is moved out of (disengaged from) the through hole 20*b*. That is, as the front side end of the releasing component 26 is pressed downward, the drum unit 20 is disengaged from (freed from) the apparatus main assembly 100 (drum unit rail 106); the drum unit 20 becomes incompletely installed.

By the way, in this specification, "drum unit 20 is in the installed state" means that the drum unit 20 is in full engagement with the positioning section 106*a*, and therefore, its upstream end, in terms of the insertion direction, is not protrusive from the apparatus main assembly 100 (drum entrance, precisely stating). That is, it means that the drum unit 20 is in the image forming position in the apparatus main assembly 100. Further, "installation position" means the position in the apparatus main assembly 100, into which the drum unit 20 is installable for image formation. Further, "drum unit 20 is not in the installation position" means that the drum unit 20 is in the apparatus main assembly 100, but, the drum unit 20 is not in engagement with the positioning section 106*a*, and the upstream end of the drum unit 20 is remaining protrusive in the upstream direction from the apparatus main assembly 100 (development unit entrance, precisely stating) by a preset amount.

By the way, when the drum unit 20 is in the installation position, the drum unit 20 is not protrusive from the apparatus main assembly 100. Therefore, the door 101 does not come into contact with the drum unit 20 when the door 101 is opened or closed. Therefore, not only is the door 101 not regulated in movement when it is opened, but also, when it is closed. When the drum unit 20 is in the installed state, and the door 101 is remaining closed, the development unit 10 is remaining positioned relative to the apparatus main assembly 100 in such a state that the preset amount of gap is present between the peripheral surface of the development sleeve 11 and photosensitive drum 21. In addition, with the door 101 remaining shut, a user is not allowed to access the drum unit 20 in the apparatus main assembly 100, and therefore, cannot pull the drum unit 20 out of the apparatus main assembly 100.

When the drum unit 20 is in the installed state, and the door 101 is open, a user can access the drum unit 20 in the apparatus main assembly 100, and therefore, can pull the drum unit 20 out of the apparatus main assembly 100. As described previously, as the door 101 is opened, the development unit 10 is separated from the drum unit 20, whereby the bearings 25*a* and 25*b* of the photosensitive drum 21 are separated from the bearings 13*a* and 13*b* of the development sleeve 11. Thus, when the door 101 is open, the drum unit 20 can be pulled out of the apparatus main assembly 100 while the bearings 13*a* and 13*b* of the development sleeve 11 are not in contact with the bearings 25*a* and 25*b* of the photosensitive drum 21. That is, when the door 101 is open, the drum unit 20 can be inserted into, or pulled out of, the apparatus main assembly 100, while preventing the bearings 13*a* and 13*b* of the development sleeve 11 and the bearings 25*a* and 25*b* of the photosensitive drum 21 from rubbing against each other, respectively.

On the other hand, in the case of a conventional image forming apparatus, the door 101 can be completely shut even when the drum unit 20 is not in the installed state, that is, even when the drum unit 20 is protrusive from the apparatus main assembly 100. However, if the drum unit 20 is pushed into the apparatus main assembly 100 by the door 101 while the door 101 is closed, the drum unit 20 is inserted into the apparatus main assembly 100 with the bearings 13*a* and 13*b* of the development sleeve 11 remaining in contact with the bearings 25*a* and 25*b* of the photosensitive drum 21. Thus, the bearings 25*a* and 25*b* of the photosensitive drum 21 are made to rub against the bearings 13*a* and 13*b* of the development sleeve 11.

In this embodiment, therefore, the image forming apparatus 1 was designed so that when the drum unit 20 is not in the installed state, the pivotal movement, more precisely, the opening movement, of the door 101 is regulated to prevent the door 101 from being completely shut. More concretely, the door 101 is provided with a rib 101*c*, which regulates the pivotal movement of the door 101 by coming into contact with the drum unit 20, if the door 101 is closed when the drum unit 20 is protrusive from the apparatus main assembly 100. Next, referring to FIGS. 13 and 14, the rib 101*c* is described.

Referring to FIG. 13, the door 101 is provided with the rib 101*c*, which is positioned so that it comes into contact the drum unit 20 as the door 101 is closed when the drum unit 20 is not completely in the installed state. The rib 101*c* which is a regulating component is shaped so that the force N (which hereafter will be referred to as "normal vector") generated in the direction which is perpendicular to the area 101*d* (surface) of contact between the rib 101*c* and the drum unit 20 as the rib 101*c* presses on the drum unit 20 does not have a positive component, that is, such a component that is directed downstream in terms of the insertion direction. That is, the rib 101*c* is shaped so that it has a surface 101*d* which comes into contact with the upstream end of the drum unit 20, in terms of the insertion direction, when the door 101 is closed, and also, that the normal line P of the surface 101*d* tilts upstream relative to a line Z which is perpendicular to the line Y which is parallel to the insertion direction. In other words, the rib 101*c* is shaped so that the angle θ between the normal line P of the surface 101*d* and the line Y which is parallel to the insertion direction becomes no less than 90 degrees.

On the other hand, the drum unit 20 is provided with a protrusion 20*a* with which the surface 101*d* of the door 101 comes into when the door 101 is closed. For example, the protrusion 20*a* is shaped and positioned so that its upstream end, that is, the upstream end of the housing 24, in terms of the insertion direction, is downwardly protrusive compared to any part of the housing 24. Thus, if the door 101 is closed while the drum unit 20 is in the incompletely installed state, the surface 101*d* of the door 101 comes into contact with the protrusion 20*a*. The provision of the protrusion 20*a* ensures that the surface 101*d* of the door 101 comes into contact with the drum unit 20 as the door 101 is closed when the drum unit 20 is in the incompletely installed state.

Because the door 101 is provided with the rib 101*c*, and the drum unit 20 is provided with the protrusion 20*a* as described above, the normal line vector N which is generated at the surface 101*d* of the door 101 does not have the aforementioned component which is directed downstream, and has a component directed upstream (indicated by arrow mark F in drawing). Therefore, when the drum unit 20 is pressed by the door 101 during the closing of the door 101, the drum unit 20 is not pressed downstream with reference to the insertion direction, and therefore, the drum unit 20 is not moved downstream. Moreover, the closing movement of the door 101 is regulated by the drum unit 20. That is, as the door 101 comes into contact with the drum unit 20 when the door 101 is closed, it is prevented from being closed further. As described above, once the door 101 comes into contact with the drum unit 20 when the drum unit 20 is in the incompletely installed state, even if additional force is applied by a user to close the door 101, the applied force does not work in the direction to push the development unit 20 into the apparatus main assembly 100. Therefore, it is impossible for the user to close the door 101 while pushing the development unit 20 into the apparatus main assembly 100 by the door 101.

Next, referring to FIG. 14, however, if the amount by which the drum unit 20 is protrusive from the apparatus main assembly 100 is insufficient, it is possible that when the door 101 is closed, a surface 101*e*, instead of the surface 101*d*, of the rib 101*c*, instead of the surface 101*d*, of the door 101 will come into contact with the drum unit 20. The surface 101*e* is such a surface that turns the force applied thereto, into the force N1 which has a component angled downstream with reference to the insertion direction. Therefore, as additional force is applied to the door 101 by a user to close the door 101 after the door 101 comes into contact with the drum unit 20 by the surface 101*e* when the door 101 is closed, the drum unit 20 is pushed into the apparatus main assembly 100 by the door 101. That is, the contact between the door 101 and drum unit 20 generates such a force that works in the direction to move the drum unit 20 downstream with reference to the insertion direction. Therefore, the closing movement of the door 101 is not regulated by the drum unit 20. Therefore, the closing of the door 101 is allowed to continue, with the door 101 remaining in contact with the drum unit 20. In order to prevent the occurrence of the above-described problem, it has to be ensured that the drum unit 20 becomes protrusive by a sufficient amount from the apparatus main assembly 100, that is, the amount which can ensure that as the door 101 is closed, the surface 101*d* of the rib 101*c* comes into contact with the drum unit 20. Thus, this issue is described with reference to FIGS. 15 to 17.

Referring to FIG. 15, in this embodiment, the aforementioned drum unit rail 106 is provided with a section 106*b* having a slanted surface 106*c* which guides the drum unit 20 into the installation position in the apparatus main assembly 100. The section 106*b* extends upstream by a preset distance from the downstream edge of the drum unit rail 106 with reference to the insertion direction. It has the slanted surface 106*c* which is slanted so that it slants downward from the downstream end 20*d* toward the upstream, with reference to the insertion direction. The slanted surface 106*c* makes up a part or the entirety of the upwardly facing surface of the section 106*b*. Thus, as the drum unit 20 is inserted into the apparatus main assembly 100, the downstream end of the drum unit 20 comes into contact with the slanted surface 106*c*, and is made to slide upward on the slanted surface 106*c* of the section 107*b* until the drum unit 20 is moved into the installation position.

Further, as described above, in order to transmit driving force to the drum unit 20, and also, to supply the development unit 20 with the electric power from the apparatus main assembly 100, the apparatus main assembly 100 is provided with a coupling section 107, which is disposed so that as the drum unit 20 is completely installed into the apparatus main assembly 100, the coupling section 107 will be between the downstream end of the drum unit 20 with reference to the insertion direction, and the rear wall of the apparatus main assembly 100. The coupling section 107 is provided with a coupling spring 107*a*, as a pressure applying component, which is between the main section of the coupling section 107 and the rear wall of the apparatus main assembly 100. Thus, when the drum unit 20 is in the installed state, it is under the pressure generated by the coupling spring 107*a* in the frontward direction, in terms of the insertion direction. Thus, unless the drum unit 20 is completely inserted into the apparatus main assembly 100, it is possible that the drum unit 20 will be moved frontward in terms of the insertion direction, and made to partially protrude from the apparatus main assembly 100, by the coupling spring 107*a* as a drum unit moving mechanism. In this embodiment, therefore, when the drum unit 20 is installed into the apparatus main assembly 100, if the positioning section 106*a* does not engage the drum unit 20, and the upstream end of the drum unit 20 is on the downstream side of the slanted surface 106*c* of the section 106*b*, the drum unit 20 is pressed upstream by the coupling spring 107*a*. As the drum unit 20 is moved upstream by the coupling spring 107*a*, the downstream end of the drum unit 20 slides down on the slanted surface 106*c* of the section 106*b* as a part of the drum unit moving mechanism. Therefore, when the drum unit 20 fails to be completely installed into the apparatus main assembly 100, or the drum unit 20 is disengaged from the positioning section 106*a*, the drum unit 20 is made to protrude from the apparatus main assembly 100 by a sufficient distance. By the way, the means for causing the drum unit 20 to partially jettison from the apparatus main assembly 100 does not need to be limited to the coupling spring 107*a*. For example, the above-described shutter spring (unshown) may be utilized.

Next, referring to part (a) of FIG. 16 through FIG. 17, the relationship between the section 106*b* of the drum unit rail 106, and the amount by which the drum unit 20 is made to protrude from the apparatus main assembly 100, is described. Part (a) of FIG. 16 is a schematic drawing of the bottom portion of the upstream end portion of the drum unit 20 and the bottom portion of the door 101 when the drum unit 20 is in the installed state. When the drum unit 20 is in the state shown in part (a) of FIG. 16, the upstream end 20*c* of the drum unit 20 in terms of the insertion direction is on the downstream side, by a distance X1, of the line which is perpendicular to the insertion direction and coincides with the rotational (pivotal) axis 101*a* of the door 101. Part (b) of FIG. 16 is a schematic drawing of the bottom portion of the upstream end portion of the drum unit 20 and the bottom portion of the door 101 when the drum unit 20 is partially protrusive from the apparatus main assembly 100. When the drum unit 20 is in the state shown in part (b) of FIG. 16, the upstream end 20*c* of the drum unit 20 in terms of the insertion direction is on the upstream side, by a distance X2, of the line which is perpendicular to the insertion direction and coincides with the rotational (pivotal) axis 101*a* of the door 101. Thus, all that is necessary to ensure that as the door 101 is closed, the surface 101*d* of the rib 101*c* comes into contact with the drum unit 20, is to cause the drum unit 20 to become protrusive from the apparatus main assembly 100 by no less than the preset amount, more specifically, the sum of the distances X1 and X2. FIG. 17 is a schematic drawing of the downstream end portion of the drum unit rail 106 and its adjacencies when the drum unit 20 is in the installed state. As long as the distance X3 from the downstream end 20*d* of the drum unit 20 in terms of the insertion direction to the upstream end of the section 106*b* of the drum unit rail 106 is greater than the sum (X1+X2) of the distances X1 and X2, it is ensured that the drum unit 20 becomes protrusive by no less than the minimum amount required. That is, all that is necessary is that the drum unit rail 106 is formed so that in terms of the insertion direction, the dimension of the section 106*b* of the drum unit rail 106 is greater than the minimum amount (X1+X2) by which the drum unit 20 is required to protrude from the apparatus main assembly 100.

As described above, in this embodiment, the door 101 is provided with the rib 101*c* which regulates the closing movement of the door 101 by coming into contact with the drum unit 20 as the door 101 is closed when the drum unit 20 is in the incompletely installed state. This rib 101*c* has the surface 101*d* which comes into contact with the drum unit 20 and generates normal vector N (FIG. 13) which does not have positive component in terms of the insertion direction. Further, the image forming apparatus 1 is structured so that as the door 101 is closed, the surface 101*d* comes into contact with the drum unit 20. Therefore, not only when the drum unit 20 is in the installed state, but also, even when the drum unit 20 is in the incompletely installed state, it does not occur that as the door 101 is closed, such force that works in the direction to push the drum unit 20 into the apparatus main assembly 100 is generated. Further, the closing movement of the door 101 is regulated by the drum unit 20. Therefore, it is impossible for a user to completely close the door 101 when the drum unit 20 is in the incompletely installed position. Therefore, it does not occur that the incompletely installed drum unit 20 is inserted into the apparatus main assembly 100 by the closing movement of the door 101. Therefore, it does not occur that the bearings 25*a* and 25*b* of the photosensitive drum 21 rub against the bearings 13*a* and 13*b* of the development sleeve 11, respectively.

By the way, even if the drum unit 20 is protrusive from the apparatus main assembly 100 by no less than a preset amount, for example, an amount which is greater than the minimum amount by which the drum unit 20 is required to be protrusive, the bearings 13*a* and 13*b* of the development sleeve 11 and the bearings 25*a* and 25*b* of the photosensitive drum 21 do not rub against each other, respectively. That is, in such a case, when the door 101 is closed, other sections of the door 101 than the rib 101*c*, that is, the portions of the door 101, which are on the opposite side of the rib 101*c* from the rotational (pivotal) axis of the door 101, come into contact with the drum unit 20, whereby the closing movement of the door 101 is regulated by the drum unit 20. Therefore, the drum unit 20 is not pushed into the apparatus main assembly 100 by the door 101.

By the way, when the drum unit 20 is in the state shown in FIG. 14, it is possible that the drum unit 20 is pushed into the apparatus main assembly 100 by the closing movement of the door 101. In such a situation, all that is necessary to prevent the bearings 25*a* and 25*b* of the drum unit 20 from rubbing against the bearings 13*a* and 13*b* of the development sleeve 11 is to place the development unit 10 to the drum unit 20 after pushing the drum unit 20 into the installation position in the apparatus main assembly 100. However, in order to insert the drum unit 20 into the installation position while preventing the development unit 10 from being moved by the closing movement of the door 101, the image forming apparatus 1 has to be increased in drum stroke. In order to increase the image forming apparatus 1 in drum stroke, the apparatus 1 has to be increased in size. Further, the distance by which the drum unit 20 can be pushed into the apparatus main assembly 10A is limited. Therefore, by structuring the image forming apparatus 1 so that if the drum unit 20 fails to be moved into the installation position, the drum unit 20 is made to protrude from the apparatus main assembly 100 by a certain distance, it is possible to enable a user to clearly determine whether or not the drum unit 20 is in the installation position or not.

By the way, in this embodiment, the component with which the rib 101*c* of the door 101 comes into contact when the door 101 is closed does not need to be the drum unit 20. For example, the image forming apparatus 1 may be structured so that the drum unit rail 106 can be pulled out of the apparatus main assembly 100 so that as the door 101 is closed, the rib 101*c* comes into contact with the drum unit rail 106. As another example, the apparatus main assembly 100 may be provided with a component (other than drum unit 20) which is moved by the drum unit 20 as the drum unit 20 is inserted into the apparatus main assembly 100, and with which the surface 101*d* of the door 101 comes into contact as the door 101 is closed. By the way, in this embodiment, the image forming apparatus 1 was structured so that the drum unit 20 was removably installable in the apparatus main assembly 100, and the development unit 10 was moved to be placed in contact with, or separated from, the drum unit 20. However, this embodiment is not intended to limit the present invention in scope. For example, the image forming apparatus 1 may be structured so that the development unit 10 is removably installable in the apparatus main assembly 100, and the drum unit 20 is moved to be placed in contact with, or separated from, the development unit 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-009831 filed on Jan. 21, 2015, which is hereby incorporated by reference herein in its entirety.

What is claimed is:

1. An image forming apparatus comprising:

a main assembly;

a drum cartridge which includes a photosensitive drum rotatable by receiving a driving force from said main assembly and on which an electrostatic latent image is formed by being exposed to light, said drum cartridge being mountable to and dismountable from a mounting position in said main assembly along a mounting and dismounting path;

a rotatable member which is provided in the main assembly and which is rotatable between a closed position on the mounting and dismounting path and an open position retracted from the mounting and dismounting path;

a developing device including a developer carrying member configured to carry a developer to develop the electrostatic latent image with toner contained in the developer;

a contact/separation mechanism for bringing said developing device into contact with and separating said developing device from said drum cartridge in interrelation with rotational motion of said rotatable member, with the contact/separation mechanism bringing said developing device into contact with said drum cartridge mounted at the mounting position such that a distance between a photosensitive surface of said photosensitive drum and a developer carrying surface of the developer carrying member is a predetermined distance;

an elastic member configured to apply an urging force to said drum cartridge toward an upstream side of a mounting direction of said drum cartridge against a mounting operation thereof;

an engaging portion configured to engage with said drum cartridge receiving the urging force to restrict movement of said drum cartridge from a mounted position toward the upstream side in the mounting direction;

wherein the drum cartridge further includes a release member for releasing engagement between said drum cartridge and said engaging portion;

wherein said drum cartridge is moved to a predetermined position in an upstream side of the mounting position with respect to the mounting direction by receiving the urging force upon release of the engagement between said drum cartridge and said engaging portion;

wherein said drum cartridge positioned at the predetermined position contacts said rotatable member subjected to a closing operation to restrict rotation of said rotating member, and said drum cartridge receives a force including a component toward upstream of the mounting direction, from said rotatable member through a contact portion with said rotatable member.

2. An image forming apparatus according to claim 1, wherein in the predetermined position, said drum cartridge, and said rotatable member are in surface contact with each other, and an angle formed between a normal line to the contacting surface and the mounting direction is not less than 90°.

3. An image forming apparatus according to claim 1, wherein said main assembly includes a guide rail configured to guide mounting and dismounting of said drum cartridge, and said guide rail is provided with an inclined surface descending upstream of the mounting direction, and wherein said cartridge released from the engagement with said engaging portion receives the urging force to descend the inclined surface to reach the predetermined position.

4. An image forming apparatus comprising:

a drum unit which includes a photosensitive drum rotatable by receiving a driving force and on which an electrostatic latent image is formed, said drum unit being mountable to and dismountable from a mounting position in said image forming apparatus along a mounting and dismounting path;

a rotatable member rotatable between a closed position on the mounting and dismounting path of said drum unit and an open position retracted from the mounting and dismounting path of said drum unit;

a developing unit including a developer carrying member configured to carry a developer to develop the electrostatic latent image with toner contained in the developer;

a contact/separation mechanism from for bringing said developing unit into contact with and separating said developing unit from said drum unit in interrelation with the rotational motion of said rotatable member;

an elastic member configured to apply an urging force to said drum unit toward an upstream side of a mounting direction of said drum unit against a mounting operation thereof; and an engaging portion configured to engage with said drum unit receiving the urging force to restrict movement of said drum unit from a mounted position toward the upstream side in the mounting direction;

wherein said drum unit further includes a release member for releasing engagement between said drum unit and said engaging portion, wherein said drum unit is moved to a predetermined position in an upstream side of the mounting position with respect to the mounting direction by receiving the urging force upon release of the engagement between said drum unit and said engaging portion, wherein said drum unit when being placed in the predetermined position contacts said rotatable member to prevent rotation of said rotatable member toward the closed position from a position where said rotatable member is contacted by said drum unit.

5. An image forming apparatus according to claim 4, wherein said drum unit receives a force having a component directed to the upstream side with respect to an inserting direction, from said rotatable member through the contact with said rotatable member.

6. An image forming operators according to claim 5, wherein said drum unit surface-contacts said rotatable member in the predetermined position, and an angle formed between a normal line of a contact surface of said drum unit at a position of the surface-contact and the inserting direction is not less than 90.

7. An image forming apparatus according to claim 4, further comprising a guide rail including an inclined surface descending toward the upstream side in the inserting direction, wherein said unit when being released from said engaging portion receives the urging force to move downward along said inclined surface to the predetermined position.

8. An image forming apparatus according to claim 4, wherein said contact/separation mechanism moves said developing unit toward said drum unit mounted to the mounting position in interrelation with a closing operation of said rotatable member so as to provide a predetermined gap between a photosensitive surface of said photosensitive drum and a developer carrying surface of said developer carrying member.

9. An image forming apparatus according to claim 8, wherein said developer carrying member is capable of being rotationally driven, and said developing unit includes a developing unit side contact portion at an outside of opposite ends of the developer carrying surface with respect to the rotational axis direction of said developer carrying member, wherein said drum unit includes a drum unit side contact portion at an outside of opposite ends of the photosensitive surface with respect to a rotational axis direction of said photosensitive drum, and wherein said developing unit side contact portions contact said drum unit side contact portions, respectively.

10. An image forming apparatus according to claim 9, wherein by contact between said drum unit when being positioned in the predetermined position and said rotatable member, a rotational motion of said rotatable member toward the closed position is prevented, so that said developing unit side contact portion and said drum unit side contact portion do not slide relative to each other.

11. An image forming apparatus according to claim 4, further comprising a coupling portion configured to transmit the driving force to said drum unit from a main assembly of said image forming apparatus, wherein said elastic member is a coupling spring of said coupling portion.

* * * * *